United States Patent [19]

Young et al.

[11] Patent Number: 4,709,746

[45] Date of Patent: Dec. 1, 1987

[54] PROCESS AND APPARATUS FOR CONTINUOUS SLURRY CASTING

[75] Inventors: Kenneth P. Young, Ballwin, Mo.; Derek E. Tyler, Cheshire, Conn.; Harvey P. Cheskis, North Haven, Conn.; W. Gary Watson, Cheshire, Conn.

[73] Assignee: Alumax, Inc., San Mateo, Calif.

[21] Appl. No.: 854,795

[22] Filed: Apr. 23, 1986

Related U.S. Application Data

[60] Continuation of Ser. No. 627,925, Jul. 5, 1984, abandoned, which is a division of Ser. No. 384,019, Jun. 1, 1982, Pat. No. 4,482,012.

[51] Int. Cl.[4] ..... B22D 11/124; B22D 27/02

[52] U.S. Cl. ..... 164/485; 164/443; 164/468; 164/504; 164/900

[58] Field of Search ..... 164/468, 504, 443, 485, 164/486, 487, 444, 900

[56] References Cited

U.S. PATENT DOCUMENTS 4,434,839 3/1984 Vogel .
4,450,893 5/1984 Winter et al. .
4,457,354 7/1984 Dantzig et al. .

FOREIGN PATENT DOCUMENTS 1208043 12/1965 Fed. Rep. of Germany .
53-16323 2/1978 Japan .

*Primary Examiner*—Kuang Y. Lin
*Attorney, Agent, or Firm*—Malcolm B. Wittenberg

[57] ABSTRACT

A process and apparatus is described for slurry casting an ingot having a non-dendritic structure across substantially its entire cross section. The casting mold has a first chamber for extracting heat from the molten material. The amount of heat extracted from the molten material and the cooling rate of the molten material is controlled to initiate growth of primary phase particles and to form a semi-solid slurry having a desired fraction solid. The mold also has a second chamber for casting the slurry into an ingot. Adjacent the exit portion of the first chamber and the inlet portion of the second chamber, a transition member is provided for delivering the slurry to the casting chamber and for preventing the ingot shell from extending back into the first chamber.

4 Claims, 9 Drawing Figures

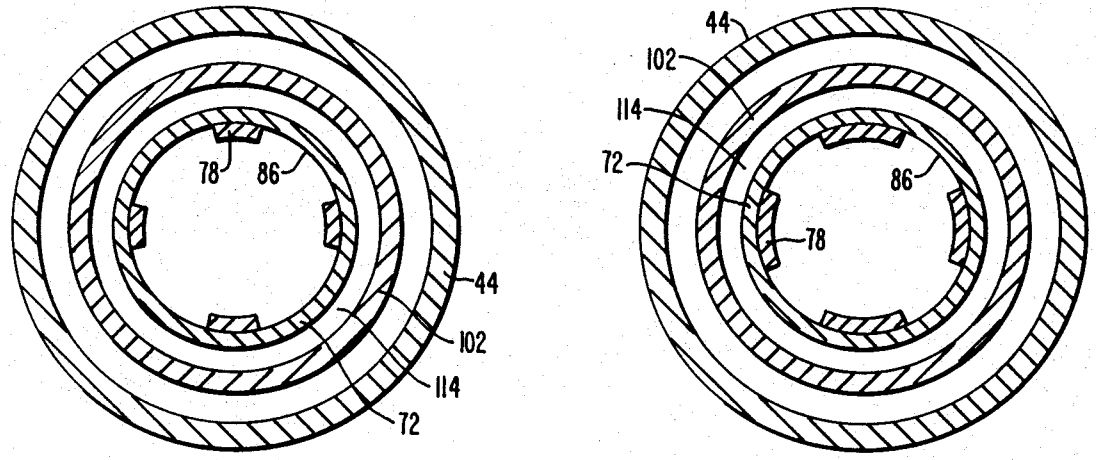
FIG._3.
FIG._4.
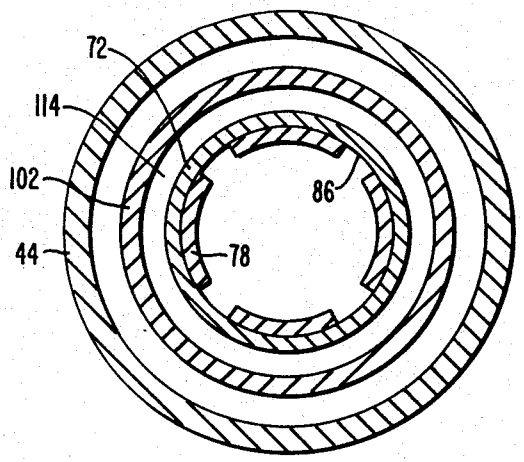
FIG._5.
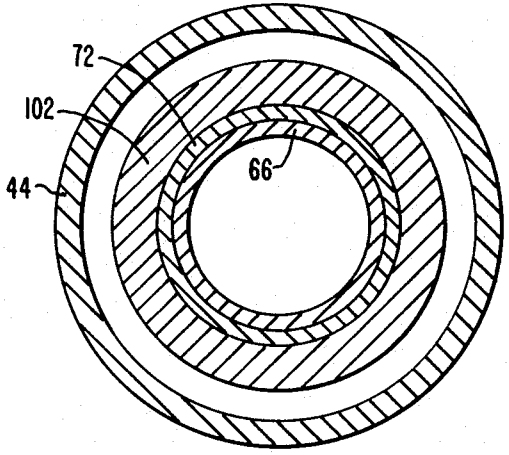
FIG._6.
FIG._7.
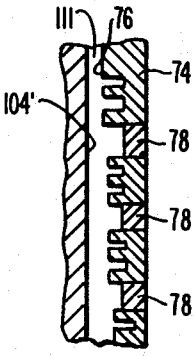
FIG._8.
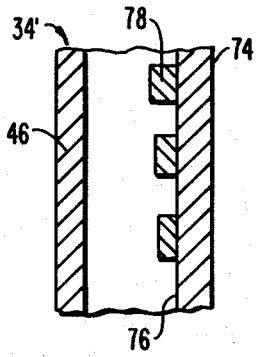
FIG._9.

PROCESS AND APPARATUS FOR CONTINUOUS SLURRY CASTING

This is a continuation of application Ser. No. 627,925, filed July 5, 1984 now abandoned which is a division of application Ser. No. 384,019 filed June 1, 1982, now U.S. Pat. No. 4,482,012.

The invention herein relates to a process and apparatus for continuous or semi-continuous slurry casting of metal or metal alloys. In particular, the invention relates to a mold for producing an ingot containing a non-dendritic or particulate structure over substantially its entire cross section.

In providing materials for later use in forming applications, it is known that materials formed from semi-solid thixotropic alloy slurries possess certain advantages. These advantages include improved part soundness as compared to conventional die casting. This results because the metal is partially solid as it enters a mold and, hence, less shrinkage porosity occurs. Machine component life is also improved due to reduced erosion of dies and molds and reduced thermal shock.

Methods for producing semi-solid thixotropic alloy slurries known in the prior art include mechanical stirring and inductive electromagnetic stirring. The processes for producing such a slurry with the proper structure require a balance between the shear rate imposed by the stirring and the solidification rate of the material being cast.

The mechanical stirring approach is best exemplified by reference to U.S. Pat. Nos. 3,902,544, 3,954,455, 3,948,650, 4,089,680, 4,108,643 all to Flemings et al. and 3,936,298 to Mehrabian et al. The mechanical stirring approach is also described in articles appearing in *AFS International Cast Metals Journal*, September, 1976, pages 11–22, by Flemings et al. and *AFS Cast Metals Research Journal*, December, 1973, pages 167–171, by Fascetta et al. In German OLS No. 2,707,774 published Sept. 1, 1977 to Feurer et al., the mechanical stirring approach is shown in a somewhat different arrangement.

In the mechanical stirring process, the molten metal flows downwardly into an annular space in a cooling and mixing chamber. Here the metal is partially solidified while it is agitated by the rotation of a central mixing rotor to form the desired thixotropic metal slurry for casting.

Inductive electromagnetic stirring has been proposed in U.S. Pat. No. 4,229,210 to Winter et al. Winter et al. use either AC induction or pulsed DC magnetic fields to produce indirect stirring of the solidifying alloy melt.

There is a wide body of prior art dealing with electromagnetic stirring techniques applied during the casting of molten metal and alloys. U.S. Pat. Nos. 3,268,963 to Mann, 3,995,678 to Zavaras et al., 4,030,534 to Ito et al., 4,040,467 to Alherny et al., 4,042,007 to Zavaras et al., 4,042,008 to Alherny et al., and 4,150,712 to Dussart as well as an article by Szekely et al. entitled "Electromagnetically Driven Flows in Metal Processing", September, 1976, *Journal of Metals*, are illustrative of the art with respect to casting metals using inductive electromagnetic stirring provided by surrounding induction coils.

The use of rotating magnetic fields for stirring molten metal during casting is known as exemplified in U.S. Pat. Nos. 2,963,758 to Pestel et al. and 2,861,302 to Mann et al. and U.K. Pat. Nos. 1,525,036 and 1,525,545.

Pestel et al. disclose both static casting and continuous casting wherein the molten metal is electromagnetically stirred by means of a rotating field. One or more multi-poled stators are arranged about the mold or solidifying casting in order to stir the molten metal to provide a fine grained metal casting. The mold may be constructed of austenitic cast iron, austenitic stainless steel, ceramic, etc. or a combination of such materials.

In U.S. patent application Ser. No. 15,250, filed Feb. 26, 1979 to Winter et al., a rotating magnetic field generated by a two-pole multi-phase motor stator is used to achieve the required high shear rates for producing thixotropic semi-solid alloy slurries to be used in slurry casting. It is known in the prior art to postpone solidification until the slurry is within the rotating magnetic field. As a result, prior art molds have been provided with insulating liners and/or insulating bands to postpone solidification. U.S. patent application Ser. Nos. 184,089, filed Sept 4, 1980 and 258,332, filed Apr. 27, 1981 both to Winter et al. disclose molds having such insulating liners and/or insulating bands. In U.S. patent application Ser. No. 289,572, filed Aug. 3, 1981 to Dantzig et al., a mold configuration for casting semi-solid thixotropic slurries and minimizing magnetic induction losses is disclosed.

It is also known in the prior art to control heat extraction from a molten material by providing a direct chill, hereinafter DC, casting mold formed by a material having a relatively low thermal conductivity and having inserts formed from a material having a high thermal conductivity. Such a mold is illustrated in U.S. Pat. No. 3,612,158 to Rossi.

Agitation of a solidifying melt during DC casting results in a cast structure which is substantially particulate or non-dendritic in nature. The DC casting process is characterized by rapid cooling rates as compared to other static or batch casting processes. Occasionally, material formed during DC casting even when subjected to shear from rotating magnetic fields contains a portion of its cross section, generally at the ingot periphery, which is dendritic in nature. This material does not behave thixotropically in the semi-solid state and thus must be removed before the DC casting can be used in a subsequent forming operation such as press forging. This is a highly undesirable and costly procedure. In addition, segregation banding which is also undesirable has been observed in such slurry cast materials.

The instant invention teaches an apparatus and process that permit continuous or semi-continuous casting of an ingot exhibiting non-dendritic structure throughout substantially its entire cross section.

The apparatus and process of the instant invention utilize a mold having a first chamber forming a heat exchanger portion, a physically separate second chamber forming a casting portion and a refractory break transition region between the exit end of the heat exchanger portion and the inlet end of the casting portion. The mold of the instant invention avoids formation of a peripheral dendritic structure by continuously converting the incoming molten material to a particulate slurry in the heat exchanger portion and then delivering the particulate slurry to the casting portion. By controlling the solid fraction of the slurry being delivered to the casting portion, the formation of dendrites in the structure of the cast ingot is substantially avoided. The mold of the instant invention also provides a substantially uniform distribution of particulate that substantially precludes segregation banding.

In accordance with the instant invention, the heat exchanger portion of the mold is provided with means for controlling the extraction of heat from the molten material and for adjusting the cooling rate to initiate particle growth and produce a slurry having a desired fraction solid under the influence of electromagnetic stirring. The heat extraction control means also forms means for controlling and limiting the formation of any preferably formed by a ring of material having a relatively low thermal conductivity.

The casting portion of the mold is formed from a material, such as copper and its alloys and aluminum and its alloys, having sufficient thermal conductivity to effect shell formation and additional solidification. Preferably, the material forming the casting portion has a thermal conductivity higher than that of the material forming the heat exchanger portion. In order to facilitate heat extraction and substantially avoid magnetic induction losses, the casting portion preferably has a minimal thickness and/or an outer wall formed with a plurality of slits.

Accordingly, it is an object of this invention to provide a process and apparatus having improved efficiency for forming a semi-solid thixotropic slurry.

It is a further object of this invention to provide a process and apparatus as above for forming a semi-solid thixotropic slurry into an ingot having a non-dendritic structure throughout substantially its entire cross section.

It is a further object of this invention to provide a process and apparatus as above having an improved mold construction for forming and casting a semi-solid thixotropic slurry.

These and other objects will become more apparent from the following description and drawings.

Embodiments of the casting process and apparatus according to this invention are shown in the drawings wherein like numerals depict like parts.

FIG. 3 is a cross-sectional view of one of the circumferential planes taken along lines 3—3 of FIG. 2.

FIG. 4 is a cross-sectional view of a second one of the circumferential planes taken along lines 4—4 of FIG. 2.

FIG. 5 is a cross-sectional view of a third one of the circumferential planes taken along lines 5—5 of FIG. 2.

FIG. 6 is a cross-sectional view of an insulating ring taken along lines 6—6 of FIG. 2.

FIG. 7 is a cross-sectional view of a refractory break taken along lines 7—7 of FIG. 2.

FIG. 8 is a schematic view in partial cross section of an alternative embodiment of the heat exchanger portion of the mold of FIG. 2.

FIG. 9 is a schematic view in partial cross section of another alternative embodiment of the heat exchanger portion of the mold of FIG. 2.

In the background of this application, there have been described a number of techniques which may be used to form semi-solid thixotropic metal slurries for use in slurry casting. Slurry casting as the term is used herein refers to the formation of a semi-solid thixotropic metal slurry directly from the liquid into a desired structure, such as a billet for later processing, or a die casting formed from the slurry.

The metal composition of a thixotropic slurry comprises islands of primary solid discrete particles enveloped by a solute-rich matrix. The matrix is solid when the metal composition is fully solidified and is a quasi-liquid when the metal composition is a partially solid and partially liquid slurry. The primary solid particles comprise degenerate dendrites or nodules which are generally spheroidal in shape. The primary solid particles are made of a single phase or a plurality of phases having an average composition different from the average composition of the surrounding matrix in the fully solidified alloy. The matrix itself can comprise one or more phases upon further solidification.

Conventionally solidified alloys have branched dendrites which develop interconnected networks as the temperature is reduced and the weight fraction of solid increases. In contrast, thixotropic metal slurries consist of discrete primary degenerate dendrite particles separated from each other by a qausi-liquid metal matrix potentially up to solid fractions of 95 weight percent. The primary solid particles are degenerate dendrites in that they are characterized by smoother surfaces and a less branched structure than normal dendrites, approaching a spheroidal configuration. The surrounding solid matrix formed during solidification of the liquid matrix subsequent to the formation of the primary solids contains one or more phases of the type which would be obtained during solidification of the liquid alloy in a more conventional process. The surrounding solid matrix comprises dendrites, single or multi-phase compounds, solid solution, or mixtures of dendrites, and/or compounds, and/or solid solutions.

The process and apparatus of the instant invention are readily adaptable to a wide range of materials including but not limited to aluminum and its alloys, copper and its alloys, and iron and its alloys.

Figure 1:
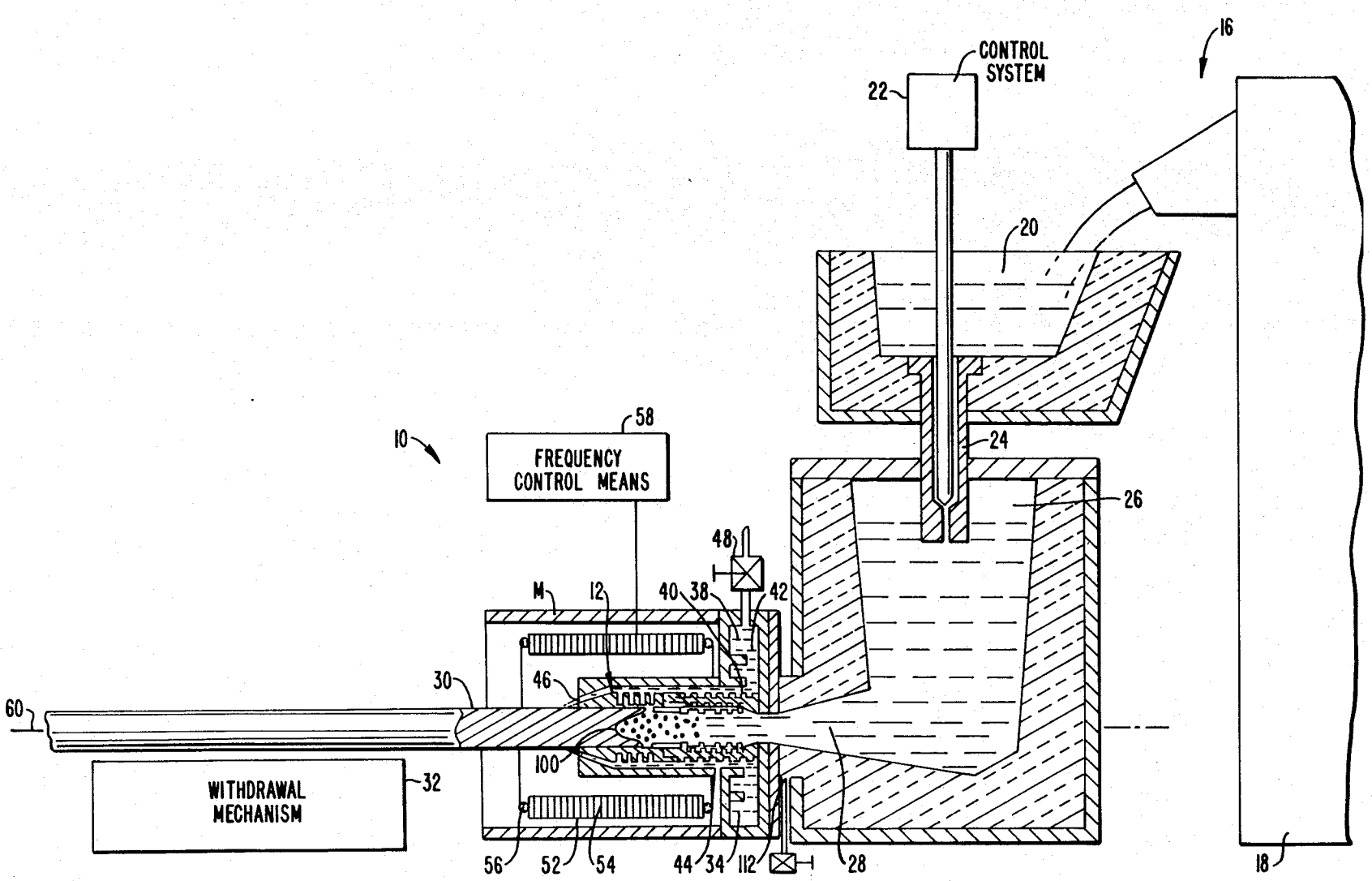
FIG. 1 is a schematic representation in partial cross section of an apparatus for casting a thixotropic semi-solid slurry in a horizontal direction.

Referring to FIG. 1, an apparatus 10 for continuously or semi-continuously slurry casting thixotropic metal slurries is shown. The cylindrical mold 12 is adpated for such continuous or semi-continuous slurry casting. The mold 12 is preferably constructed in a manner to be described hereinafter.

Mold 12 is preferably cylindrical in nature. The apparatus 10 is particularly adapted for making cylindrical ingots utilizing a conventional two-pole polyphase induction motor stator for stirring. However, it is not limited to the formation of a cylindrical ingot cross section since it is possible to achieve transversely or circumferentially moving magnetic fields with a non-circular tubular mold arrangement not shown.

The molten material is supplied to mold 12 through supply system 16. The molten material supply system comprises the partially shown furnace 18, trough 20, molten material flow control system or valve 22, downspout 24 and tundish 26. Control system 22 controls the flow of molten material from trough 20 through downspout 24 into tundish 26. Control system 22 also controls the height of the molten material in tundish 26. Alternatively molten material may be supplied directly through furnace 18 into tundish 26. The molten material exits from tundish 26 horizontally via conduit 28 which is in direct communication with the inlet to casting mold 12.

Solidifying casting or ingot 30 is withdrawn from mold 12 by a withdrawal mechanism 32. The withdrawal mechanism 32 provides the drive to the casting or ingot 30 for withdrawing it from the mold section. The flow rate of molten material into mold 12 is controlled by the extraction of casting or ingot 30. Any suitable conventional arrangement may be utilized for withdrawal mechanism 32.

In order to provide a means for stirring a molten metal within the mold 12 to form the desired thixotropic slurry, a two-pole multi-phase induction motor stator 52 is arranged surrounding the mold 12. The stator 52 is comprised of iron laminations 54 about which the desired windings 56 are arranged in a conventional manner to preferably provide a three-phase induction motor stator. The motor stator 52 is mounted within the motor housing M. Although any suitable means for providing power and current at different frequencies and magnitudes may be used, power and current are preferably supplied to stator 52 by a variable frequency generator 58. The motor stator 52 is arranged concentrically about the axis 60 of the mold 12 and the casting 30 formed within it.

It is preferred to utilize a two-pole three-phase induction motor stator 52. One advantage of the two-pole motor stator 52 is that there is a non-zero field across the entire cross section of the mold 12.

The magneto-hydrodynamic stirring force generated by the magnetic field created by motor stator 52 extends generally tangentially of the inner mold wall. This sets up within the mold cavity a rotation of the molten metal which generates the desired shear for producing the thixotropic slurry. The magneto-hydrodynamic stirring force vector is normal to the heat extraction direction and is, therefore, normal to the direction of dendrite growth. By maintaining a desired average shear rate over the solidification range, i.e. from the center of the slurry to the inner mold wall, an improved shearing of the dendrites as they grow may be obtained.

Even when subjected to shear from rotating magnetic fields, material formed using DC casting may contain a portion of its cross section, generally at the ingot periphery, which is dendritic in nature. The mold 12 of the instant invention substantially eliminates this problem and produces a cast ingot 30 having a substantially uniform distribution of non-dendritic structure throughout substantially its entire cross section. The substantially uniform distribution of particulate throughout the structure substantially precludes any segregation banding.

The mold 12 comprises a heat exchanger portion 62, a casting portion 64, and a refractory break 66. The heat exchanger portion 62 is designed so that the extraction of heat from the molten material and the consequent temperature decrease of the molten material may be controlled to produce under the influence of electromagnetic stirring a semi-solid slurry. By adjusting the cooling rate of the molten material to initiate particle growth, a slurry consisting of solid primary phase material in high solute liquid is provided to the casting portion to produce the desired cast structure. The heat exchanger portion 62 is also designed to prevent the formation therein of any shell structures that would impede the development and transfer of the slurry.

The temperature decrease in a molten material along the length of a heat exchanger having a given diameter for a given metal or metal alloy system is principally defined by the thermal characteristics of the mold and the casting speed. The proper balance of these two parameters will dicate for a given inlet temperature of the molten material the fraction solid of primary phase material of the slurry being delivered to the casting portion inlet 70.

A heat exchanger having constant high thermal characteristics along its length produces a non-uniform dendritic shell which becomes progressively thicker towards the exit end of the heat exchanger. This situation is extremely undesirable since as shell thickness increases the magnetic field loss correspondingly increases, reducing the shear rate in the melt and thus the ability to effectively stir the slurry. Excessive shell build-up can increase the required velocity through the heat exchanger, thus reducing the available heat transfer time such that control of the slurry temperature cannot be maintained. Additionally, excessive shell thickening can form a bridge and close off flow, thus terminating casting. The heat exchanger portion 62 of the mold of the instant invention successfully avoids these problems.

Heat exchanger portion 62 is formed by member 72 having inner and outer walls 74 and 76. Inner wall 74 defines the heat exchanger portion of the mold cavity. The cross-sectional shape of the mold cavity formed by wall 74 may be round, square, rectangular, dog-bone or any other desired shape. Member 72 is preferably tubular in nature.

Member 72 may be formed from any material having suitable thermal characteristics, such as stainless steel, graphite, etc. For example, it may be formed from a material having a relatively low thermal conductivity. Heat is extracted from the molten material through the walls of the member 72.

In order to control the extraction of heat from the molten material so that a slurry having a desired fraction solid may be formed, a plurality of insulating members 78 are used to define the total effective heat transfer area of the heat exchanger portion. The insulating members 78 preferably lie in a plurality of circumferential planes 80–84. Each circumferential plane contains one or more of the members 78. The exposed area or areas 86 of each plane not encompassing one or more of the members 78 define the effective heat transfer area of each circumferential plane.

The members 78 are preferably formed from a material having substantially no thermal conductivity. Any suitable low thermal conductivity material such as ceramic or glass may be used to form members 78. Since there is substantially no heat transfer through the members 78, the heat extracted from the molten material primarily travels through the member 72 at the exposed exposed areas 86. By adjusting the size of the areas 86 in the circumferential planes, the heat extracted from the molten material and consequently the average cooling rate may be controlled so as to initiate solid particle growth and convert the incoming molten material into a semi-solid slurry having a desired fraction solid.

Preferably, the circumferential planes containing members 78 are separated by a plurality of insulating rings 88. The insulating rings 88 are formed from the same material as that forming members 78. The insulating rings assist in controlling the heat extracted from the molten material.

In a preferred embodiment, members 78 are mounted to the inner wall 74. Any suitable conventional means may be used to affix members 78 to the wall 74. In lieu of mounting the members 78 to inner wall 74, members 78 may be embedded in tubular member 72 as shown in FIG. 8 so as to have sufaces contiguous with inner and outer walls 74 and 76.

Alternatively, as shown in FIG. 9, members 78 may be mounted to outer wall 76. The portions between the members 78 in each circumferential plane define the effective heat transfer areas. When mounted to the outer wall 76, members 78 are preferably in contact with a coolant enclosed by a cooling manifold 34'.

The effective heat transfer areas 86 may lie in a plurality of axial planes or may be staggered about the heat exchanger portion. The areas 86 may be staggered by staggering the insulating members 78 from plane to plane.

It should also be noted that the heat extracted from the molten material may be controlled by changing the spacing of members 78 and/or changing their configuration to alter the size of areas 86. The size of the circumferential segment defined by each insulating member 78 depends upon the nature of the system being cast and the inlet temperature of the molten material. Different materials may require different effective heat transfer areas in the circumferential planes.

Since the molten material contains more heat adjacent the entry of heat exchanger portion 62 than at the exit of the heat exchanger portion, it is desirable to provide the upstream circumferential planes with a greater effective heat transfer area than the downstream circumferential planes. FIGS. 3–5 illustrate this. If desired, a plurality of the upstream circumferential planes 80, 81 and 82 may have the same effective heat transfer area. Alternatively, the effective heat transfer area may decrease from the most upstream circumferential plane 80 to the most downstream circumferential plane 84.

By controlling the heat extracted from the molten material in the above manner, it is possible to control the temperature of the molten material so that instead of a liquid, a semi-solid slurry is delivered to the casting portion 64.

As well as controlling the heat extracted from the molten material, the members 78 and insulating rings 88 assist in limiting the size of any shell that forms. Since there is substantially no heat conducted through the members 78 and the rings 88, the growth of any dendritic shell formed adjacent one of the areas 86 would be inhibited by contact with one of the members 78 or insulating rings 88. Each member 78 and each ring 88 should have a thickness and a length sufficient to prevent thickening and bridge over of any shells formed in adjacent areas 86. By limiting the growth of any shells, problems such as increased magnetic field loss, reduced stirring efficiency and impeded flow conditions may be avoided. By properly controlling the throughput of the molten material, the formation of contiguous dendritic shells in the heat exchanger portion may be completely avoided.

If desired, heat exchanger portion 62 may be provided with a feed nozzle 90. Feed nozzle 90 is preferably formed from an insulating material such as a ceramic.

It is known in the prior art that molds formed of an electrically conductive material tend to absorb significant portions of an induced magnetic field. This mold absorption effect increases as the frequency of the inducing current increases. In order to minimize such magnetic induction losses, the thickness of member 72 should be minimized. Furthermore, outer wall 76 may be provided with a plurality of slits 92. The slits 92 minimize the path length of any currents induced in the member 72 and minimize any magnetic induction losses.

Refractory break 66 acts as a transition region between heat exchanger portion 62 and casting portion 64. Refractory break 66 is preferably formed by a ring of material having substantially no thermal conductivity. Any suitable low thermal conductivity material such as a refractory type material sold under the name Pyrotherm may be used.

The function of the refractory break 66 is twofold. First, it serves to separate any shell growth in the heat exchanger portion 62 from the shell growth in the casting portion 64. Second, it acts as a conduit through which the semi-solid particulate slurry is transferred between the other two portions of the mold.

The refractory break provides a region across which there is substantially no heat transfer. Therefore, any shell formed in heat exchanger portion 62 would be prevented from growing into casting portion 64 since the lack of heat transfer would inhibit shell growth. In a similar fashion, the shell formed in casting portion 64 would be prevented from extending back into heat exchanger portion 62. By limiting the growth of the shell formed in the casting portion in this fashion so that only a shell having a finite length is formed, the problems associated with shell fracture may be avoided. The refractory break should have sufficient length and thickness to prevent shell bridge over.

With respect to its slurry transfer function, the geometry of the refractory break 66 exerts influence over the fluidics of the system. The heat exchanger end 96 of the refractory break should be similar in section to the heat exchanger portion to avoid dead zones adjacent the transition region. The casting end 98 of the refractory break should be suitably contoured to control flow of the slurry into casting portion 66. It is desirable to control the slurry motion so as to fill the solidifying cavity or sump 100 to ensure minimal shrinkage porosity in the resultant cast ingot 30. The length of the refractory break and the diameter of the transfer passageway 94 should be chosen so as to optimize the slurry transfer process. If the diameter is too great, turbulent flow into casting portion 64 will be encouraged. If the diameter is too small or the length too great, added stirring may be imparted to the heat exchanger portion 62 with relatively quiescent transfer into the casting portion 64. Ideally, the slurry flow through the refractory break should be sufficient to maintain the desired casting rate.

The casting portion 64 comprises a chamber 102 formed from any suitable material having sufficient heat transfer characteristics to effect solidification. For example, any suitable high thermal conductivity material, such as copper and its alloys or aluminum and its alloys, may be used to form the casting portion. The material forming chamber 102 preferably has a thermal conductivity higher than the material forming member 72. Chamber 102 has an inner wall 104 which forms the casting portion of the mold cavity and an outer wall 106. The cross-sectional shape of the mold cavity formed by wall 104 may be round, square, rectangular, dog-bone, or any other desired shape as determined by the cross-sectional shape desired for the casting to be produced. Chamber 102 is preferably tubular in nature. Outer wall 106 has a plurality of slits 108 cut therein to minimize magnetic induction losses. In order to further minimize magnetic induction losses, the overall wall thickness of chamber 102 should be minimized. If desired, casting portion 64 may be physically separate from heat exchanger portion 62 and may be attached thereto by any suitable means such as threads 110.

A cooling manifold 34 is arranged circumferentially around the outer wall 106. The particular manifold shown includes a first input chamber 38 and a second chamber 40 connected to the first input chamber by a narrow slot 42. A coolant jacket sleeve 44 formed from a suitable material is attached to the manifold 34. A discharge slot 46 is defined by the gap between the coolant jacket sleeve 44 and the outer wall 106. A uniform curtain of coolant, preferably water, is provided about the outer mold wall 106. The coolant serves to carry heat away from the molten metal via the inner wall 104. The coolant exits through slot 46 discharging directly against the solidifying ingot. A suitable valving arrangement 48 is provided to control the flow rate of the water or other coolant discharged in order to control the rate at which the metal or metal alloy solidifies. In the apparatus 10, a manually operated valve 48 is shown; however, if desired, this could be an electrically operated valve or any other suitable valve arrangement.

The mold 12 is preferably provided with a system 111 for supplying lubricant to inner wall 104. The lubricant helps prevent the metal or metal alloy from sticking to the mold wall 104 and assists in the heat transfer process by filling any gaps formed between wall 104 and the solidifying ingot as a result of solidification shrinkage.

The lubricant system 111 comprises inlet 112 for supplying lubricant to passageway 114 between heat exchanger portion outer wall 76 and casting portion inner wall 104'. Lubricant in passageway 114 is transmitted to a chamber 116 via any suitable connecting passageway such as slots not shown in threads 110. From chamber 116, lubricant is permitted to flow down the inner wall 104. To prevent lubricant from flowing into heat exchanger portion 62, a sealing ring 118 within a slot is provided between inner wall 74 and refractory break 66. Any suitable conventional sealing means such as a gasket may be used for sealing ring 118.

The lubricant may comprise any suitable material and may be applied in any suitable form. In a preferred arrangement, the lubricant comprises rapeseed oil provided in fluid form. Alternatively, the lubricant may comprise powdered graphite, high temperature silicone, castor oil, other vegetable and animal oils, esters, paraffins, other synthetic liquids or any other suitable lubricant typically utilized in the casting arts. Furthermore, if desired, the lubricant may be injected as a powder which melts as soon as it comes into contact with the molten metal.

It should be noted that the lubrication system assists in removing heat from the heat exchanger portion. Heat transferred through the heat exchanger portion 62 at heat transfer areas 86 will be transmitted through the lubricant in passageway 114 and through walls 104' and 106 to the coolant in cooling manifold 34.

The molten metal which is poured into the mold 12 is also cooled under controlled conditions by means of the water flowing over the outer wall 106 of the mold 12 from the encompassing manifold 34. By controlling the rate of water flow along the wall 106, the rate of heat extraction from the molten metal within the mold 12 is in part controlled.

If it is desired to use a heat exchanger system as shown in FIG. 9 having insulating members 78 mounted to the outer wall 76 of heat exchanger portion 62 and surrounded by a cooling manifold 34', any suitable lubrication system may be utilized in lieu of lubrication system 111.

It is preferred that the stirring force field generated by the stator 52 extend over a region from about the most upstream circumferential plane containing insulating members 78 to the most downstream point of the solidification zone of the thixotropic metal slurry. By having the stirring force field extend over this region, the desired semi-solid particulate slurry may be formed and transmitted to the casting portion 64 and the casting 30 should have a structure comprising a slurry cast structure throughout substantially its entire cross section. Any dendrites that may initially form normal to the periphery of the mold should be readily sheared off by the metal flow resulting from the rotating magnetic field of the induction motor stator 52. The dendrites which are sheared off continue to be stirred to form degenerate dendrites. Degenerate dendrites can also form directly within the slurry because the rotating stirring action of the melt does not permit preferential growth of dendrites.

Figure 2:
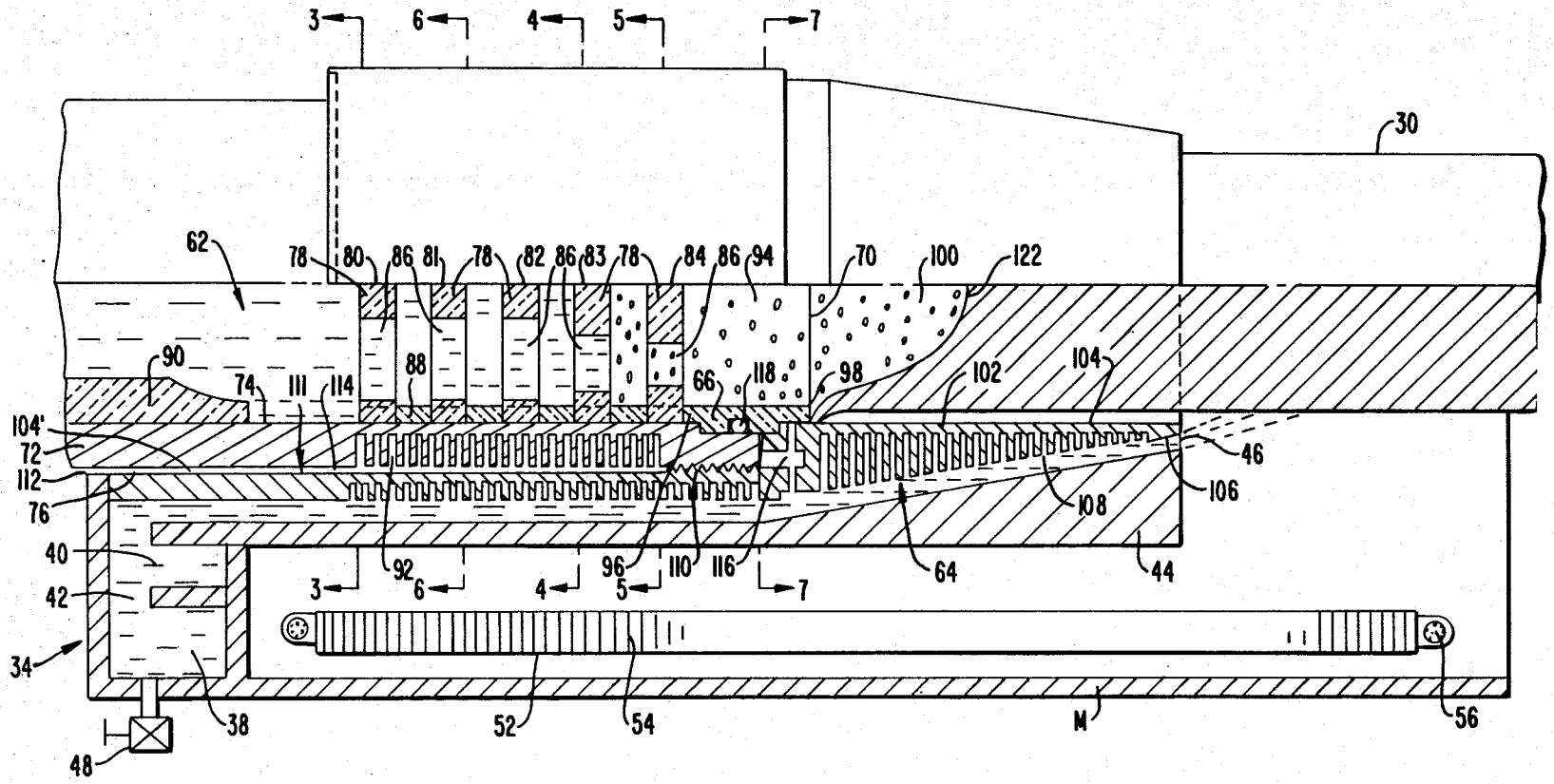
FIG. 2 is a schematic view of a mold to be used in the apparatus of FIG. 1.

Stator 52 preferably has a length that extends over the full length of the solidification zone. In particular, the stirring force field associated with the stator 52 should preferably extend over the full length and cross section of the solidification zone with a sufficient magnitude to generate the desired shear rates. As shown in FIG. 2, the solidification zone preferably comprises a sump 100 of molten metal slurry within the casting portion 64 which extends from about the casting portion inlet to the solidification front 122 which divides the solidified casting 30 from the slurry. The solidification zone extends at least from the region of the initial onset of solidification and slurry formation in the mold cavity to the solidificatiion front 122.

To form a slurry casting 30 utilizing the apparatus 10 of FIG. 1, molten metal is poured into the mold cavity while motor stator 52 is energized by a suitable three-phase AC current of a desired magnitude and frequency. After the molten metal is poured into the mold cavity, it is stirred continuously by the rotating magnetic field produced by stator 52. By controlling the heat extracted from the molten material in heat exchanger portion 62 and the casting speed, a semi-solid slurry having a sufficiently high fraction solid that production of any dendrite surface in the ingot 30 will be substantially eliminated may be produced and transferred to casting portion 64. Within casting portion 64, a solidifying shell is formed about the thixotropic slurry. As the solidifying shell is formed on the casting 30, the withdrawal mechanism 32 is operated to withdraw casting 30 at a desired casting rate.

The apparatus 10 is capable of casting a continuous member such as a bar, rod, wire, etc. having any desired radius, shape, and length.

In order that the invention may be more fully understood, the following example is given by way of illustration.

A 2" diameter ingot of aluminum alloy A 357 was horizontally cast using the apparatus shown in FIGS. 1–7. The heat exchanger portion had five 0.25 inch wide circumferential planes or heat transfer slots each separated by a 0.25 inch pyrotherm insulating ring. Each circumferential plane or heat transfer slot had alternating pyrotherm insulating members which exposed specific heat transfer area. The heat exchanger material was stainless steel and the effective heat transfer area decreased toward the casting portion. The refractory break comprised a ring of pyrotherm material having a length of about 0.94 inches. The casting portion was formed from a copper alloy comprising about 0.6% Cr and the remainder consisting essentially of copper.

The three most upstream circumferential planes had an effective heat transfer area of 240°. The fourth or penultimate circumferential plane had an effective heat transfer area of 160°. The most downstream circumferential plane had an effective heat transfer area of 120°.

Casting was done using a line current of about 24 amps and a frequency of about 250 Hz. At a casting speed of about 20 inches per minute, the temperature decrease along the centerline of the heat exchanger portion was approximately 25° C. resulting in a delivery temperature, the temperature of the slurry entering the refractory break, of 605° C. which is approximately 10° C. below the liquidus temperature for alloy A 357.

The cast microstructure obtained by delivering a slurry instead of a liquid consisted of a non-dendritic periphery. In addition, the uniform distribution of particulate substantially precluded the segregation banding occasionally observed in conventionally DC stir cast A 357.

The above example shows that the instant invention permits one to select a wide range of heat transfer conditions in the heat exchanger to attain a desired temperature decrease to form a semi-solid slurry having a desired fraction solid. The proper balance of shearing via electromagnetic stirring and heat transfer permit delivery of a slurry to a casting portion so that an ingot having a non-dendritic structure across substantially its entire cross section may be formed.

Suitable shear rates for carrying out the process of this invention comprise from at least about 400 sec.$^{-1}$ to about 1500 sec.$^{-1}$ and preferably from at least about 500 sec.$^{-1}$ to about 1200 sec.$^{-1}$. For aluminum and its alloys, a shear rate of from about 700 sec.$^{-1}$ to about 1100 sec.$^{-1}$ has been found desirable.

The line frequency for casting aluminum having a radius from about 1 inch to about 10 inches should be from about 3 to about 3000 hertz and preferably from about 9 to about 2000 hertz.

The required magnetic field strength is a function of the line frequency and the melt radius and should be from about 50 to 1500 gauss and preferably from about 100 to about 800 gauss for casting aluminum.

The particular parameters employed can vary from metal system to metal system in order to produce the desired thixotropic slurry.

Magneto-hydrodynamic as the term is used herein refers to the process of stirring molten metal or slurry using a moving or rotating magnetic field. The magnetic stirring force may be more appropriately referred to as a magnetomotive stirring force which is provided by the moving or rotating magnetic field of this invention.

While the invention herein has been described in terms of a particular continuous or semi-continuous casting system, the mold may be used in conjunction with other types of casting systems which utilize magneto-hydrodynamic stirring of some portion of the melt during solidification.

While the invention has been described in terms of a horizontal casting system, the mold may be used in conjunction with a vertical casting system or a casting system having any desired orientation.

While the heat extraction control means has been described in terms of a plurality of circumferential planes containing insulating members separated by insulating rings, the heat extraction control means could be a continuous liner having a varying thickness. The liner is preferably formed by a material having relatively low thermal conductivity.

The patents, patent applications and publications set forth in the specification are intended to be incorporated by reference herein.

It is apparent that there has been provided in accordance with this invention a process and apparatus for continuous slurry casting which fully satisfies the objects, means and advantages set forth hereinbefore. While the invention has been described in combination with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A mold for use in a system for casting molten material, said mold comprising:

first chamber means for extracting heat from said molten material, said first chamber means having means for controlling the amount of heat extracted from the molten material and the cooling rate of the molten material so as to initiate growth of primary phase particles of said material and control solidification to form a semi-solid heterogeneous slurry having a fraction solid comprising said particles sufficient to form a cast structure having a shell and a non-dendritic structure across substantially its entire cross-section, said first chamber means having inner and outer walls formed from a material having the desired thermal conductivity and an exit end;

said controlling means comprising a plurality of spaced apart members lying in at least one circumferential plane, said members being formed from a material having substantially no thermal conductivity wherein the areas between said spaced apart members in each said plane form an effective heat transfer area for removing said heat from said molten material through said walls and wherein said controlling means comprise a plurality of said circumferential planes, each said circumferential plane containing a plurality of said spaced apart members defining said effective heat transfer area, a most upstream one said circumferential planes having the first effective heat transfer area, a most downstream one of said circumferential planes having a second effective heat transfer area wherein said first effective heat transfer area being greater than said second effective heat transfer area;

second chamber means for casting said semi-solid slurry into an ingot having a shell and said cast structure, said second chamber means having an inlet end; and transition means between the exit end of said first chamber means and the inlet end of said second chamber means for delivering said semi-solid slurry to said casting means and for preventing said shell in said first chamber means from extending into said second chamber means and preventing said shell in said second chamber means from extending back into said first chamber means.

2. The mold of claim 1 further comprising:

at least three circumferential planes;

said effective heat transfer area decreasing from a most upstream one of said circumferential planes to a most downstream one of said circumferential planes.

3. A process for casting a molten material, said process comprising:

providing a mold having first chamber means for containing said molten material, second chamber means for casting said material into an ingot and transition means between the exit end of said first chamber means and the inlet end of said second chamber means for delivering said material to said second chamber;

extracting heat from said molten material in said first chamber means;

controlling the amount of said heat extracted from said molten material and the cooling rate of said molten material so as to initiate growth of primary phase particles of said molten material and control solidification to form a semi-solid heterogeneous slurry within said first chamber means, said slurry having a fraction solid comprising said particles sufficient to form a cast structure having a shell and a non-dendritic structure across substantially its entire cross-section;

delivering said slurry to said second chamber means;

solidifying said semi-solid slurry within said second chamber means into said ingot having said cast structure and a shell; said transition means preventing any of said shell formed in said first chamber means from extending into said second chamber means and preventing said shell in said second chamber means from extending back into said first chamber means;

providing a plurality of circumferential planes containing at least member formed of a material having a relatively low thermal conductivity, each said circumferential plane having its effective heat transfer area defined by that portion of said plane non-encompassing said at least one member;

providing a most upstream one of said circumferential planes with a first effective heat transfer area;

providing a most downstream one of said circumferential planes with a second effective heat transfer area less than said first effective heat transfer area; and extracting said heat from said molten material through said heat transfer areas.

4. The process of claim 3 further comprising:

providing insulating means formed of a material having a relatively low thermal conductivity between adjacent ones of said circumferential planes.

* * * * *